US007380732B2

(12) United States Patent
Bolman et al.

(10) Patent No.: US 7,380,732 B2
(45) Date of Patent: Jun. 3, 2008

(54) MULTIPLE DISCHARGE ORIFICE SPRAY NOZZLE

(75) Inventors: Bart R. Bolman, Montgomery, IL (US); Gary Paulsen, Batavia, IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 11/524,931

(22) Filed: Sep. 21, 2006

(65) Prior Publication Data

US 2007/0069047 A1 Mar. 29, 2007

Related U.S. Application Data

(60) Provisional application No. 60/720,181, filed on Sep. 23, 2005.

(51) Int. Cl.

| | |
|---|---|
| ***B05B 1/14*** | (2006.01) |
| ***B05B 11/26*** | (2006.01) |
| ***B05B 9/00*** | (2006.01) |
| ***B05B 1/00*** | (2006.01) |
| *B05B 1/20* | (2006.01) |

(52) U.S. Cl. ..... 239/568; 239/567; 239/597; 239/601; 239/159

(58) Field of Classification Search ..... 239/568, 239/567, 597, 601, 159, 432, 461, 504, 518, 239/523, 524, 548, 550, 556–559, 566, 592–595, 239/522

See application file for complete search history.

(56) References Cited

U.S. PATENT DOCUMENTS

| | | | | |
|---|---|---|---|---|
| 2,856,236 | A * | 10/1958 | Hunziker | 239/515 |
| 3,082,961 | A | 3/1963 | Hruby, Jr. | |
| 3,085,754 | A | 4/1963 | Thompson | |
| 3,342,423 | A | 9/1967 | Hruby, Jr. et al. | |
| 3,421,702 | A | 1/1969 | O'Brien et al. | |
| 4,185,781 | A | 1/1980 | O'Brien | |
| 4,353,508 | A | 10/1982 | Butterfield et al. | |
| 4,356,974 | A | 11/1982 | Rosenberg et al. | |
| 4,567,934 | A * | 2/1986 | Nakao et al. | 164/444 |
| 4,815,665 | A | 3/1989 | Haruch | |
| 4,828,182 | A | 5/1989 | Haruch | |
| 4,899,937 | A | 2/1990 | Haruch | |
| 5,190,222 | A | 3/1993 | Haruch | |
| 5,275,340 | A | 1/1994 | Haruch | |
| 5,333,794 | A * | 8/1994 | Haruch | 239/600 |
| 6,098,896 | A * | 8/2000 | Haruch | 239/8 |
| 6,764,024 | B2 | 7/2004 | Crampton | |

* cited by examiner

*Primary Examiner*—Darren Gorman
(74) *Attorney, Agent, or Firm*—Leydig, Voit & Mayer, Ltd.

(57) ABSTRACT

A spray tip for discharging a controlled liquid spray distribution is provided. The spray tip includes a spray tip body having an inlet end for connection to a pressurized liquid supply. The spray tip body includes a first fluid chamber having a first longitudinal axis and a second fluid chamber in fluid communication with the first fluid chamber and having a second longitudinal axis that extends transversely relative to the first longitudinal axis. A pair of discharge orifices are formed in the spray tip body. Each discharge orifice has a downstream side with a deflector surface for directing liquid discharging from the chamber. Each discharge orifice intersects the second fluid chamber adjacent a respective end thereof so as to define a pocket extending downstream of the deflector surface.

18 Claims, 1 Drawing Sheet

MULTIPLE DISCHARGE ORIFICE SPRAY NOZZLE

CROSS-REFERENCE TO RELATED APPLICATIONS

This patent application claims the benefit of U.S. Provisional Patent Application No. 60/720,181, filed Sep. 23, 2005.

FIELD OF THE INVENTION

The present invention relates generally to spray nozzles, and more particularly, to spray nozzles of the type which have a spray tip with a transversely oriented deflector flange for effecting a downwardly directed discharging spray pattern.

BACKGROUND OF THE INVENTION

Spray nozzle assemblies are known, such as shown in U.S. Pat. No. 5,275,340 assigned to the same assignee as the present invention, that include a deflector flange which enhances liquid particle breakdown and directs the spray pattern in a transverse direction. Such spray nozzles do not necessarily require pressurized air pre-atomization of the liquid flow stream. These spray nozzles have particular utility in spraying agricultural chemicals because they do not generate extremely fine liquid particles. Nozzles that produce extremely fine liquid particles are generally unsuited for agricultural applications because the discharging spray can be subject to undesirable drifting. Nevertheless, even with nozzles specifically designed for agricultural applications it can be difficult to effect complete coverage of a crop canopy by the downwardly directing spray because the spray often has difficulty achieving good penetration of the crop canopy.

OBJECTS AND SUMMARY OF THE INVENTION

It is a general object of the present invention to provide a spray nozzle assembly having a spray tip adapted for discharging a controlled liquid spray distribution for more complete coverage of crops during agricultural spraying.

Another object is to provide a spray tip of the foregoing type that is relatively simple in design and which lends itself to economical manufacture.

Other objects and advantages of the invention will become apparent upon reading the following detailed description and upon reference to the drawings, in which:

BRIEF DESCRIPTION OF THE DRAWING(S)

Figure 1:
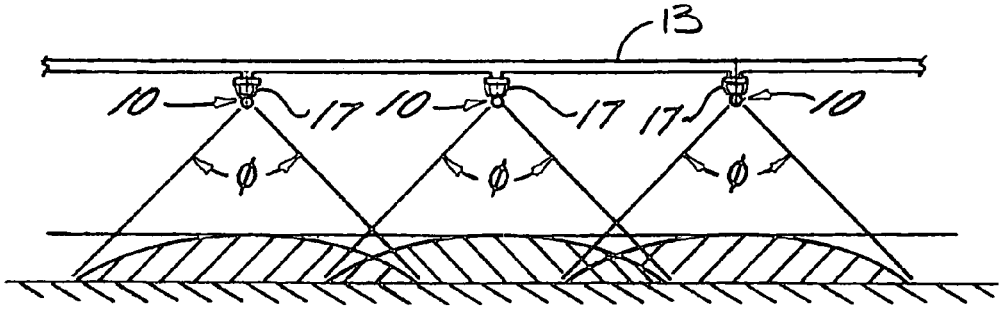
FIG. 1 is a diagrammatic depiction of a plurality of nozzle assemblies having spray tips according to the invention mounted in laterally spaced relation on an exemplary spray boom.

While the invention is susceptible of various modifications and alternative constructions, a certain illustrated embodiment thereof has been shown in the drawings and will be described below in detail. In should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

Referring now more particularly to the drawings, there is shown in FIG. 1 an illustrative spray boom 13 having mounted thereon a plurality of spray nozzle assemblies 17 each of which incorporates a spray tip 10 in accordance with the invention. The spray boom can be the boom of an agricultural sprayer as the spray tip of the present invention has particular utility in spraying of liquid chemicals for agricultural purposes. The illustrated boom is a tubular member through which the supply liquid is directed to the individual spray nozzle assemblies. Additional details regarding how the spray tip may be incorporated as part of a spray nozzle assembly which is mounted on a spray boom of an agricultural sprayer are disclosed in the aforementioned U.S. Pat. No. 5,275,340, the disclosure of which is incorporated hereby reference.

Figure 2:
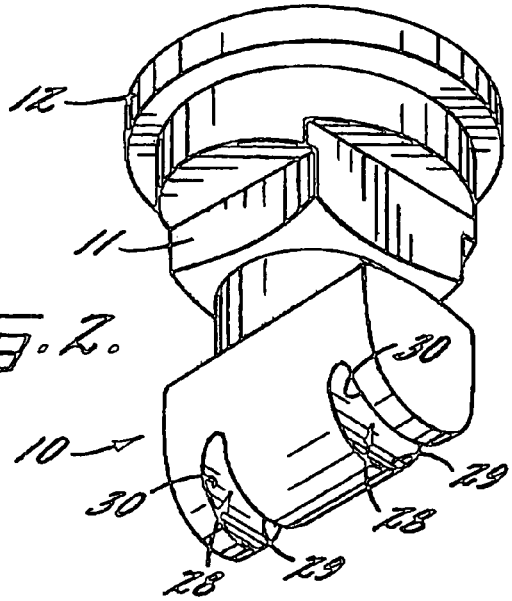
FIG. 2 is a perspective of an illustrative spray tip in accordance with the invention.
Figure 3:
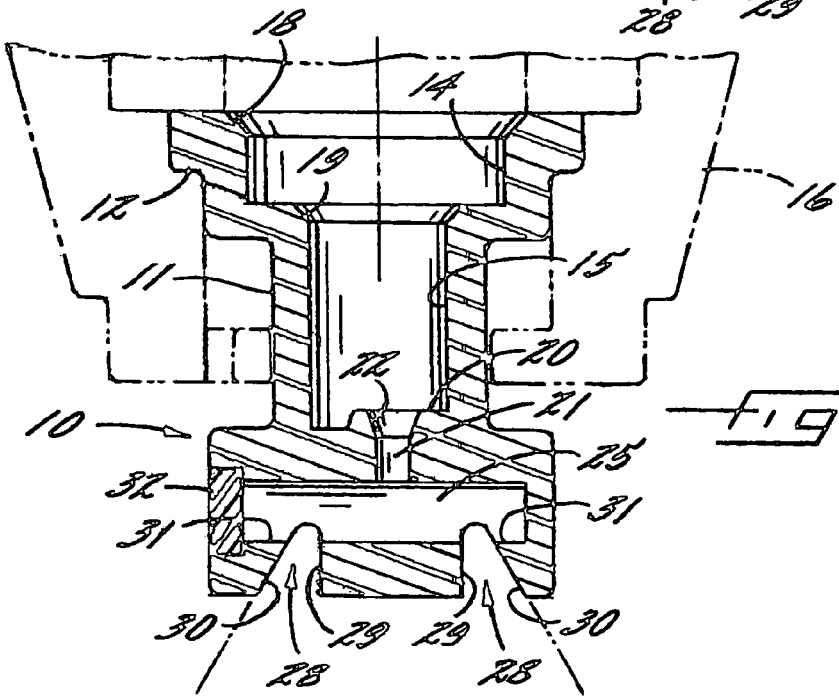
FIG. 3 is an enlarged vertical section of the spray tip shown in FIG. 1.

Referring to FIGS. 2 and 3, the spray tip 10 in this case has a one-piece body 11, preferably molded of plastic, formed with an outwardly extending mounting flange 12 at its upstream end for releaseable securement to a liquid supply conduit or stem by an appropriate retention cap 16 (see FIG. 3) or the like. The illustrated spray tip body 11 is formed with a first cylindrical chamber 14 that communicates with a coaxial, second smaller diameter cylindrical chamber 15. The cylindrical chambers 14, 15 each have a separate tapered chamber or throat 18, 19 at its upstream end. The second or downstream cylindrical chamber 15 has a bottom or end wall 20 formed with a coaxial pre-orifice 21 which similarly has a tapered entry throat 22. The pre-orifice 21 in this case communicates with a horizontal cylindrical chamber 25 disposed below the second cylindrical chamber 15. The pre-orifice 21 communicates with a top side of the horizontal chamber 25 at an intermediate location.

In accordance with the invention, the spray tip body 11 is formed with a plurality of discharge orifices 28 defined by cross slits extending upwardly from an underside of the nozzle body. The spray tip body 11 in this case has a pair of discharge orifices 28 each disposed adjacent a respective end of the horizontal chamber 25 on opposite sides of the pre-orifice 21. The discharge orifices 28 each have an upstream face 29 that is vertically oriented and a downstream face or deflector surface 30 disposed at a small angle to the vertical, such as 30°. The discharge orifice defining cross slots each are disposed upstream of a respective end of the horizontal chamber 25 so as to define a distinct pocket or recess 31 downstream of the deflector surface 30. The illustrated discharge orifice defining cross slots extend upwardly into the horizontal chamber a distance slightly less than the radius of the horizontal chamber. To facilitate plastic injection molding of the nozzle body 11, it will be appreciated by one skilled in the art that the plastic body 11 may be formed with a horizontal chamber 25 that is open at one end, which can thereafter be closed by a plastic plug, 32 secured by ultrasonic welding.

During a spray operation, it will be seen that a liquid flow stream directed axially through the spray tip 10 will proceed through the cylindrical chambers 14, 16, the pre-orifice 21, and then transversely through the horizontal chamber 25, for simultaneous discharge through the discharge orifices 28. Each spray stream will be discharged in a direction slightly outwardly of the longitudinal or vertical axis of the spray tip 10 for simultaneous and relatively complete coverage of the canopy of the crops being sprayed. It will be understood by one skilled in the art that the size relationships of the vertical cylindrical chamber 15, the pre-orifice 21, the horizontal chamber 25, and the location and size of the discharge orifices 28 relative to the respective ends of the horizontal chamber 25, combine to create a discharging spray pattern without such fine liquid particles that are subject to undesirable drift. In the preferred embodiment, the vertical chamber 15 has a diameter greater than twice the diameter of the pre-orifice 21, and the horizontal chamber 25 has a diameter that is greater than the diameter of the pre-orifice 21, up to about twice the diameter of the pre-orifice.

From the foregoing, it can be seen that the spray tip of the present invention has particular utility for the efficient direction of liquid chemicals in agricultural spraying. The spray tip also is a relatively simple design and lends itself to economical plastic injection manufacture.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A liquid spray tip for discharging a controlled liquid spray distribution comprising:

a spray tip body including an inlet end for connection to a pressurized liquid supply;

said spray tip body including a first cylindrical fluid chamber having a first longitudinal axis;

said spray tip body including a second cylindrical fluid chamber in fluid communication with the first fluid chamber and having a second longitudinal axis that extends transversely relative to the first longitudinal axis, said second chamber having closed ends at its opposite longitudinal ends, said spray body having a pre-orifice less than the diameter of said first and second chambers communicating between said first and second chambers, said spray tip body having a pair of discharge orifices communicating with said second chamber, said discharge orifices each having a downstream side with a deflector surface for directing liquid discharging from the second chamber, said discharge orifices each intersecting the second fluid chamber adjacent a respective end thereof so as to define a pocket extending beyond the deflector surface to the respective closed end of the second chamber, said discharge orifices each extending into said second chamber at least a distance corresponding to slightly less than the radius of said second chamber such that said deflector surface directs liquid from said second chamber with a controlled liquid spray distribution without prior air atomization of the supply liquid.

2. The liquid spray tip according to claim 1 wherein the pre-orifice communicates with the second fluid chamber at a location between the pair of discharge orifices.

3. The liquid spray tip according to claim 1 wherein the pre-orifice has a tapered entry throat.

4. The liquid spray tip according to claim 1 wherein the downstream deflector surface of each of the discharge orifices extends at an angle relative to a transverse axis that extends perpendicular to the second longitudinal axis of the second fluid chamber, and said deflector surfaces each extending outwardly of said second chamber in diverging relation to each other for directing liquid in diverging relation to each other from said discharge orifices.

5. The liquid spray tip according to claim 4 wherein each of the discharge orifices includes an upstream face that extends parallel to the transverse axis.

6. The liquid spray tip according to claim 1 wherein the spray tip body includes a third fluid chamber arranged upstream of and in fluid communication with the first fluid chamber.

7. The liquid spray tip according to claim 6 wherein a tapered throat is arranged between the first and third fluid chambers.

8. The liquid spray tip of claim 1 in which said second fluid chamber has a diameter less than approximately twice the diameter of said pre-orifice.

9. The spray tip according to claim 1 in which said second chamber is smaller in diameter than said first chamber.

10. A spray tip for discharging a controlled liquid spray distribution comprising:

a spray tip body including an inlet end for connection to a pressurized liquid supply;

said spray tip body including a first cylindrical fluid chamber having a first longitudinal axis;

said spray tip body including a second cylindrical fluid chamber in fluid communication with the first fluid chamber and having a second longitudinal axis that extends transversely relative to the first longitudinal axis, said second chamber having closed ends at its opposite longitudinal ends;

a pair of discharge orifices formed in the spray tip body, said discharge orifices having a downstream side with a deflector surface for directing liquid discharging from the second chamber, said discharge orifices each intersecting said second fluid chamber adjacent a respective end thereof so as to define a pocket extending beyond the deflector surface to the respective closed end of the second chamber;

said spray tip body having a pre-orifice arranged between the first and second fluid chambers;

said pre-orifice and second fluid chamber each have a substantially cylindrical configuration, said pre-orifice having a cross-sectional area less than a cross-sectional area of said second fluid chamber; and said second fluid chamber having a diameter less than approximately twice the diameter of the pre-orifice.

11. The spray tip of claim 10 in which said spray tip discharge orifices each extend into said second chamber a distance at least slightly less than the radius of the second chamber.

12. A liquid spray tip for discharging a controlled liquid spray distribution comprising:

a spray tip body including an inlet end for connection to a pressurized liquid supply;

said spray tip body including a first cylindrical fluid chamber having a first longitudinal axis;

said spray tip body including a second cylindrical fluid chamber having a second longitudinal axis that extends transversely relative to the first longitudinal axis, said spray tip body having a pre-orifice less than the diameters of said first and second chambers communicating between said first and second chambers, said second cylindrical fluid chamber having closed ends at its opposite longitudinal ends;

a pair of discharge orifices formed in the spray tip body, said discharge orifices each having a downstream side with a deflector surface for directing liquid discharging from the second chamber, said discharge orifices each intersecting said second fluid chamber adjacent a respective closed end thereof so as to define a pocket extending beyond the deflector surface to the respective closed end, and said deflector surfaces each extending at an acute angle outwardly of said second chamber in diverging relation to each other for directing a controlled liquid spray from said discharge orifices in diverging relation to each other without prior air atomization of the supply liquid.

13. The liquid spray tip according to claim 12 in which said acute angle of each reflector surface is approximately 30°.

14. The liquid spray tip of claim 12 in which said discharge orifices each include an upstream face that extends parallel to the transverse axis.

15. The liquid spray tip according to claim 12 in which said second chamber is smaller in diameter than said first chamber.

16. The liquid spray tip according to claim 12 in which said discharge orifices each extend into said second chamber a distance at least slightly less than the radius of the second chamber.

17. A liquid spraying system for directing a liquid spray comprising:

a liquid supply, a liquid supply line for receiving liquid from said liquid supply, a spray tip having a body with an inlet end for connection to said liquid supply line for receiving liquid, said spray tip body including a first cylindrical fluid chamber having a first longitudinal axis;

said spray tip body including a second cylindrical fluid chamber in fluid communication with the first fluid chamber and having a second longitudinal axis that extends transversely relative to the first longitudinal axis, said second chamber having closed ends at its opposite longitudinal ends, said spray tip body having a pre-orifice less than the diameter of said first and second chambers communicating between said first and second chambers, said spray tip body having a pair of discharge orifices formed in the spray tip body communicating with said second chamber, said discharge orifices each having a downstream side with a deflector surface for directing liquid discharging from the second chamber, said discharge orifices each intersecting the second fluid chamber adjacent a respective end thereof so as to define a pocket extending beyond the deflector surface to the respective closed end of the second chamber, and said discharge orifices each extending into said second chamber at least a distance corresponding to slightly less than the radius of said second chamber such that said deflector surface directs liquid from said second chamber with a controlled liquid spray distribution without prior air atomization of the supply liquid.

18. The liquid spraying system of claim 17 in which said second chamber has a diameter smaller than the diameter of said first chamber.

* * * * *